US005484969A

United States Patent [19]

McKendree et al.

[11] Patent Number: 5,484,969

[45] Date of Patent: Jan. 16, 1996

[54] HIGH-VOLUME ACOUSTIC TRANSDUCER

[75] Inventors: Francis S. McKendree, Harrison City; Dexter V. Wright, Pittsburgh; Peter D. Hill, Monroeville; Stanley S. Sattinger, Pittsburgh, all of Pa.

[73] Assignee: Westinghouse Electric Corporation, Pittsburgh, Pa.

[21] Appl. No.: 280,642

[22] Filed: Jul. 25, 1994

[51] Int. Cl.[6] ..... H04R 23/00

[52] U.S. Cl. ..... 181/142; 381/150; 116/137 R; 116/24; 116/DIG. 18; 367/140

[58] Field of Search ..... 381/153, 154, 381/156, 165; 116/137 R, 137 A, 147, 24, DIG. 18; 181/142; 367/140

[56] References Cited

U.S. PATENT DOCUMENTS

| | | | |
|---|---|---|---|
| 1,571,378 | 2/1926 | Schloemilch | 116/137 R |
| 1,829,991 | 11/1931 | Hetzel | 116/137 R |
| 2,458,043 | 1/1949 | Zenner | 179/108 |
| 3,407,273 | 10/1968 | Arnold | 179/108 |
| 3,517,390 | 6/1970 | Whitehead | 116/137 R |
| 4,517,915 | 5/1985 | Olsson et al. | 116/137 R |
| 4,649,853 | 3/1987 | Powell | 116/147 |
| 4,709,652 | 12/1987 | Douglass, Jr. et al. | 116/140 |
| 5,060,274 | 10/1991 | Asami et al. | 381/166 |

FOREIGN PATENT DOCUMENTS 56-116395 9/1981 Japan .

*Primary Examiner*—J. Woodrow Eldred

[57] ABSTRACT

A high-volume source for very low frequency applications in which conventional speakers are inadequate is disclosed. A presently preferred embodiment comprises a reservoir 32 with a pressure relief 33; a controller 34; a supply blower 36; an exhaust blower 38; a positive plenum 40; a negative plenum 42; an orifice plate with valving 44; a horn 46; and pressure transducers 48, 50, 52, 54, feeding detected pressure levels to the controller 34. An electrical command signal s(t) is also input to the controller. The command signal is a voltage analogous to the acoustic pressure or volume velocity to be output by the source.

31 Claims, 4 Drawing Sheets

(a) ASSUMED COMMAND SIGNAL (DESIRED VOLUME VELOCITY INJECTED INTO HORN)
FIG.5A
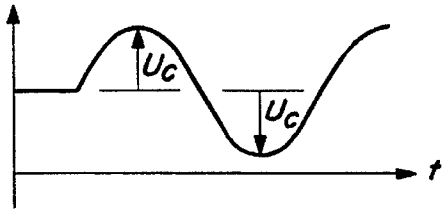
(b) VOLUME VELOCITIES THROUGH INDIVIDUAL VALVES/VALVE GROUPS
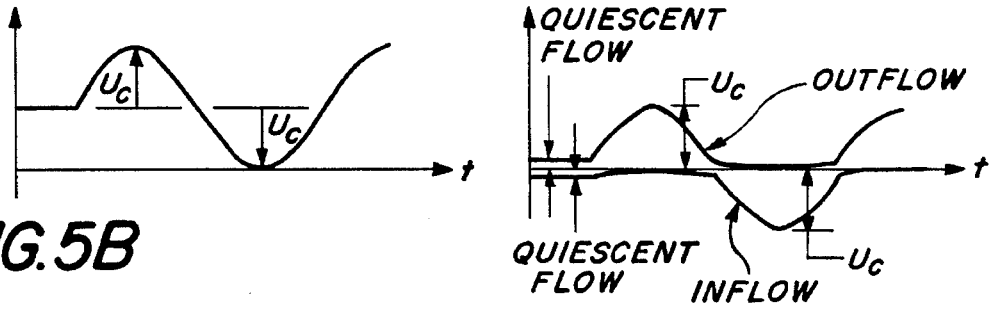
FIG.5B
(c) NET VOLUME VELOCITY INTO HORN (ASSOCIATED WITH ACOUSTIC OUTPUT)
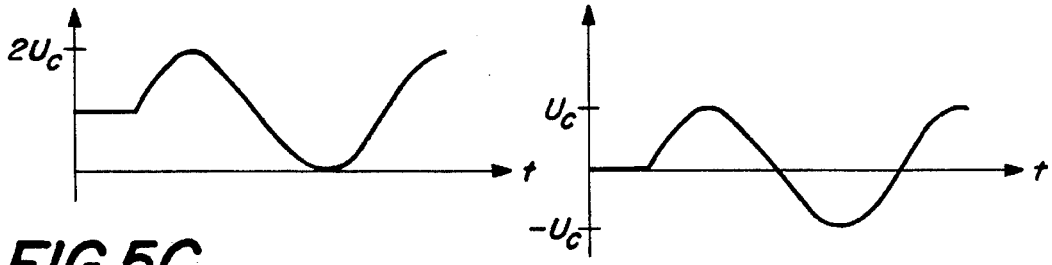
FIG.5C
(d) TOTAL ABSOLUTE VOLUME VELOCITY (ASSOCIATED WITH POWER LOSS DUE TO FLOW)
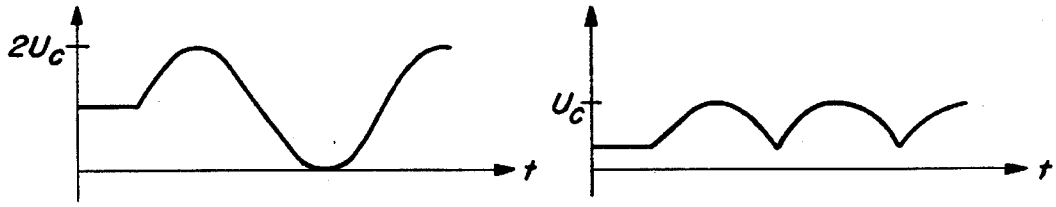
FIG. 5D

HIGH-VOLUME ACOUSTIC TRANSDUCER

BACKGROUND OF THE INVENTION

The present invention relates generally to the field of acoustic transducers and more particularly to high-volume acoustic transducers. One presently preferred application of the invention is in the field of active noise control, e.g., in a power generation plant.

High-Volume Acoustic Transducers

Sources in which an air flow is modulated can produce very high sound power and sound pressure levels. For example, sirens have been built with acoustic outputs of 26 kW and efficiencies of 30% (sinusoidal) to 70% (square wave). In a siren, the air flow is modulated by one or more chopper valves. Typically, a supply blower, chopping rotor, and motor share a common shaft. A siren is a periodic source and usually can be operated efficiently over only a limited frequency range. Since a siren's mechanical inertia is large, its speed and frequency cannot be changed quickly. Therefore, sirens are unsuitable for use as an active noise control source.

Controllable acoustic sources have been designed using modulating valves. Typically, the valves are driven by a linear motor to modulate the air flow from a supply to an output device such as a duct or horn. These sources can produce acoustic outputs of tens or hundreds of kilowatts. Known designs use comparatively small valves that can be accelerated quickly without requiring prohibitively large mechanical forces. However, such small valves impose a relatively large pressure drop (e.g., 30 psi). Therefore, a large amount of pneumatic power is consumed in driving the air flow through the valves.

Several prior art devices (e.g., Wyle WAS-2000 and Ling EPT 2005) employ a pressure source connected to an output device through a modulating valve whose area is changed with time. The output of this source is superimposed on a steady quiescent flow. These are open-circuit device, requiring a continuous supply of air or other working fluid. Sources such as this are typically operated with their valves half open when the signal amplitude is zero. The input/output characteristics of such sources are markedly non-linear because (1) the valve(s) have non-linear flow characteristics, and (2) there are acoustic non-linearities associated with high-amplitude pressure oscillations. In addition, a large amount of pneumatic power is typically required, and a large amount of flow-generated noise is present even in the absence of a desired acoustic output.

An example of a prior art high output acoustic source is disclosed in Japanese Patent No. 56-116395 (Ueno). The disclosed "speaker with air valve" employs a plurality of valves sized in binary increments. This patent discloses the use of a separate horn for each spatially separated valve. This design is believed to be flawed in several respects. First, time delays between signal components of different amplitude, even those of the same frequency, arise as a consequence of using horns of different sizes. Further, it is difficult to design valves covering a flow range of $2^N$ for N of about 8 or more while assuring that all valves open in the same period of time. Moreover, the spatial separation of the horns causes the acoustic output to be incoherent, i.e., to bear little relation to the nominal sum of the flows from each valve if operated alone.

One goal of the present invention is to provide a high-volume source for very low frequency applications in which conventional speakers are inadequate. Another goal of the invention is to provide a control mechanism for producing a linear acoustic signal with a simple process that converts the desired acoustic pressure to a sequence of valve operations.

Active Noise Control

As mentioned above, one presently preferred application of the invention disclosed herein is in connection with an active noise control system. Free-field noise sources, such as internal combustion engines and combustion turbines, generate powerful low-frequency noise in the 16 Hz and 31 Hz octave bands (where the 16 Hz octave band extends from 11 Hz to 22 Hz, and the 31 Hz octave band extends from 22 Hz to 44 Hz). Passive noise control requires the use of large, expensive silencers to absorb and block the noise. The size and cost of such silencers makes passive control unacceptable for many applications. An alternative to passive control is a combination of passive control and active control. Passive control abates noise better as the frequency of the noise increases and active control works better as the frequency of the noise decreases. Therefore, a combination of passive and active noise control works best in many applications.

The active control of sound or vibration involves the introduction of a number of controlled "secondary" sources driven such that the field of acoustic waves generated by these sources destructively interferes with the field generated by the "primary" source. The extent to which such destructive interference is possible depends on the geometric arrangement of the primary and secondary sources and on the spectrum of the field produced by the primary source. Considerable cancellation of the primary field can be achieved if the primary and secondary sources are positioned within a half-wavelength of each other at the frequency of interest.

One form of primary field of particular practical importance is that field produced by rotating or reciprocating machines. The waveform of the primary field generated by such machines is nearly periodic and, since it is generally possible to directly observe the action of the machine producing the original disturbance, the fundamental frequency of the excitation is generally known. Therefore, each secondary source can be driven at a harmonic of the fundamental frequency by a controller that adjusts the amplitude and phase of a reference signal and uses the resulting "filtered" reference signal to drive the secondary source. In addition, it is often desirable to make this controller adaptive, since the frequency and/or spatial distribution of the primary field may change with time and the controller must track this change. The present disclosure is directed not to the control algorithm employed in connection with active noise control, but rather to the mechanism employed to produce a high-volume, low-frequency acoustic field.

The strength of an idealized source is measured by the "volume velocity," which is the product of the velocity of a vibrating surface and its area, or the integral of the normal component of velocity over the surface, if the velocity is not uniform. Since conventional loudspeakers have limited displacements, the velocity, and therefore the acoustic output, decreases in proportion to frequency. Conventional loudspeakers are capable of radiating at most a few watts at low frequencies and have efficiencies of a few percent at best. Under these conditions, on the order of one hundred loudspeaker systems may be required for active noise control. Moreover, these loudspeakers require tens of thousands of electrical watts of amplification. Furthermore, conventional loudspeakers are built with minimal cone mass to increase efficiency (which is inversely proportional to the moving cone mass), making such conventional loudspeakers subject to failure when driven at high levels for extended periods of time. This limitation is particularly significant in industrial plant noise control, where the loudspeakers must be placed outdoors in a physically hostile environment.

Another object of the present invention is to overcome the limitations of conventional loudspeakers by providing a compact and rugged high-volume acoustic source capable of producing a high volume velocity output. The high-volume source should be available in a very rugged and yet easily replaceable module, which would make the source easy to maintain.

In addition, another goal of the present invention is to provide a high-volume acoustic source capable of being adapted for use with a variety of fluids. In this regard, there are several instances where fluids other than air would be desired. For example, stack gas may be insonified to produce cancellation of low-frequency or infrasound inside an exhaust stack before it reaches the air; high amplitude signals may be coupled to water for use in sonar systems and undersea communication; and exhaust gas from an engine may be insonified to reduce the pressure fluctuations at the exhaust outlet, reducing the noise radiated from a tail pipe.

SUMMARY OF THE INVENTION

Accordingly, the present invention provides a high-volume source for very low frequency applications in which conventional speakers are inadequate. The invention also provides for the production of a linear acoustic signal with a simple process that converts the desired acoustic pressure to a sequence of valve operations. The invention may also be used to overcome the limitations of conventional loudspeakers by providing a compact, rugged, and easily replaceable high-volume acoustic source. The high-volume acoustic source is also adaptable for use with a variety of fluids and a variety of applications, including the insonification of stack gas to produce cancellation of low-frequency or infrasound inside an exhaust stack, the production of high amplitude signals in water for use in sonar systems and undersea communication, and the insonification of exhaust gas from an engine to reduce the noise radiated from the tail pipe.

A high-volume acoustic source in accordance with the present invention comprises a positive plenum; a negative plenum; blower means for supplying a fluid to the positive plenum and withdrawing the fluid from the negative plenum; an orifice plate containing a plurality of valves for controllably releasing the fluid from the positive plenum and accepting the fluid into the negative plenum; and a controller for controlling the operations of the valves in accordance with an electrical signal. According to the invention, an acoustic signal generated by the high-volume source is analogous to the electrical signal.

One presently preferred embodiment of the invention, also comprises a reservoir containing the fluid. In addition, this preferred embodiment includes a horn coupled to the orifice plate for matching the acoustic impedance of the source to a free space. This embodiment also includes first, second, and third pressure transducers in the plena and reservoir, respectively. The pressure transducers feed pressure levels detected in the plena and reservoir to the controller, which allows the controller to compensate for changes in pressure in converting the electrical signal to a sequence of valve operations. A feedback pressure transducer is also preferably positioned outside the plena adjacent to the orifice plate. The feedback pressure transducer feeds pressure levels indicative of the acoustic signal generated by the high-volume source to the controller. In addition, the reservoir comprises a pressure relief port having a high flow impedance for relieving an under-pressure or over-pressure condition in the reservoir.

In one embodiment of the invention, the blower means comprises a supply blower coupled between the reservoir and the positive plenum, and an exhaust blower coupled between the reservoir and the negative plenum. In another embodiment, the blower means comprises a single blower coupled between the positive plenum and negative plenum. The latter embodiment does not employ a reservoir.

Other features of the invention are disclosed below.

BRIEF DESCRIPTION OF THE DRAWINGS

FIG. 5, comprising parts (a) through (d), depicts a waveform contrasting a closed circuit high-volume acoustic source in accordance with the present invention with a prior art high-volume acoustic source.

DETAILED DESCRIPTION OF PREFERRED EMBODIMENTS

A first embodiment of the present invention comprises three principal components:

1) A set of quick-acting electric, electropneumatic, or fluidic valves (with the valve type chosen to meet requirements of simplicity, output magnitude, and frequency range), each of which admits a predetermined volume flow into a manifold;
2) A manifold which muffles the switching transients and conducts the summed flow to a horn, which radiates the summed flow into the ambient fluid; and
3) A controller which converts an electrical signal analogous to the desired acoustic signal to the valve operations required to produce that signal.

The valves admitting fluid to the manifold could be scaled in binary increments, admitting, for example, 1, ½, ¼, etc., cubic meters of air to the manifold. Alternatively, the valves admitting fluid to the manifold would preferably admit equal increments of, for example, 0.01 cubic meters per second to the manifold. The latter approach is preferable because it is extremely difficult to make valves of much different sizes open and close in equal increments of time.

Very high precision can be obtained by pulse-width modulating one of the source valves at its maximum frequency of operation, so as to minimize the error in the resultant acoustic signal. Digitization noise will be present at harmonics of the switching frequency, therefore above the frequency range of interest and amenable to passive control if necessary. In applications involving active noise control, the source would typically be operated below 100 Hz with a sample rate of, for example, 250 Hz on the larger valves. An acoustic signal of, for example, 1 cubic meter per second peak could be generated by modulating the flow into the manifold from a minimum of 0 to a maximum of 2 cubic meters per second.

Figure 1:
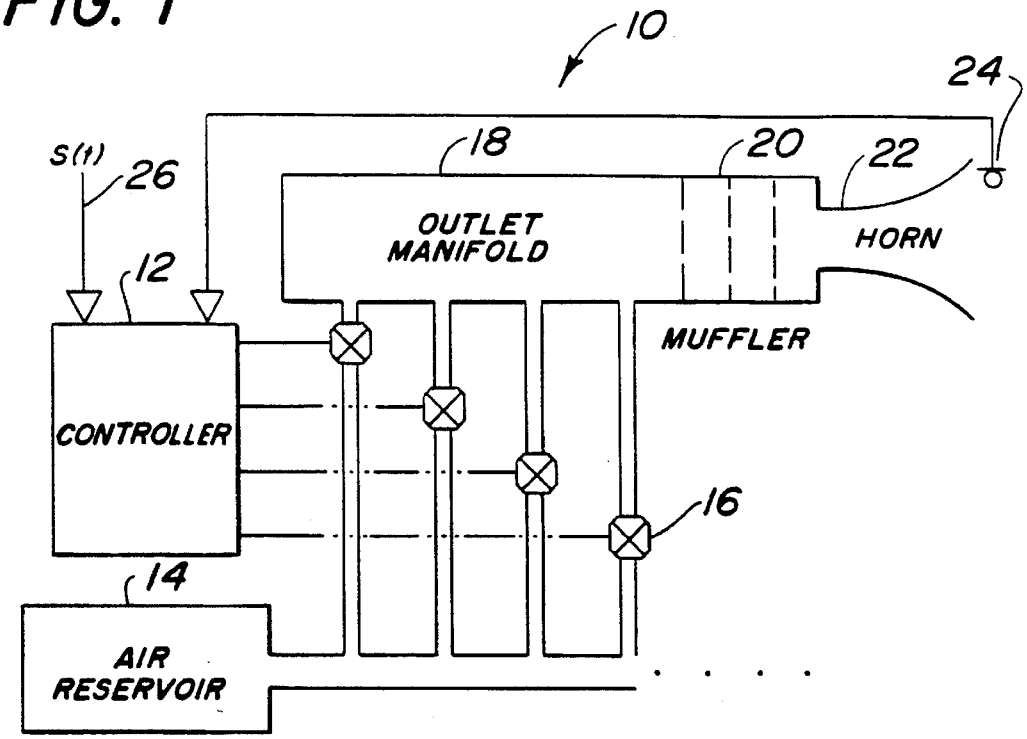
FIG. 1 schematically depicts a first embodiment of a high-volume acoustic source in accordance with the present invention.

Referring now to FIG. 1, the first embodiment of a high-volume acoustic source 10 in accordance with the present invention comprises a controller 12; an air reservoir 14; a plurality of valves 16; an outlet manifold 18; a muffler 20; a horn 22; a feedback transducer 24; and an input 26 for receiving an electrical control signal s(t). The dimensions of the outlet manifold 18 are preferably less than a wavelength of the frequencies of interest, and the velocities in the manifold should be less than the speed of sound. For example, if a 100 Hz upper frequency limit is sought in air at STP (Standard Temperature and Pressure), the manifold preferably should be less than 3.45 meters in its longest dimension. The velocities of flow should be 34.5 meters per second (Mach 0.1) or less. A preferred embodiment of the source 10 employs a large number of valves 16, each of which admits a small volume of air. Large flows would be controlled by switching a multiplicity of valves in parallel. For example, if a flow of 0.011 $m^3/s$ is to be admitted through an orifice with the velocity of 34.5 meters per second, the diameter must be about 1.92 cm. If a peak flow of 2 $m^3/s$ is desired, 200 such orifices must enter the manifold 18. These could be accommodated on a sphere of about 54 cm (21 inches) in diameter with a packing fraction of only 25%. Such a spherical manifold would have a diameter of only 0.15 wavelength at 100 Hz.

Figure 2:
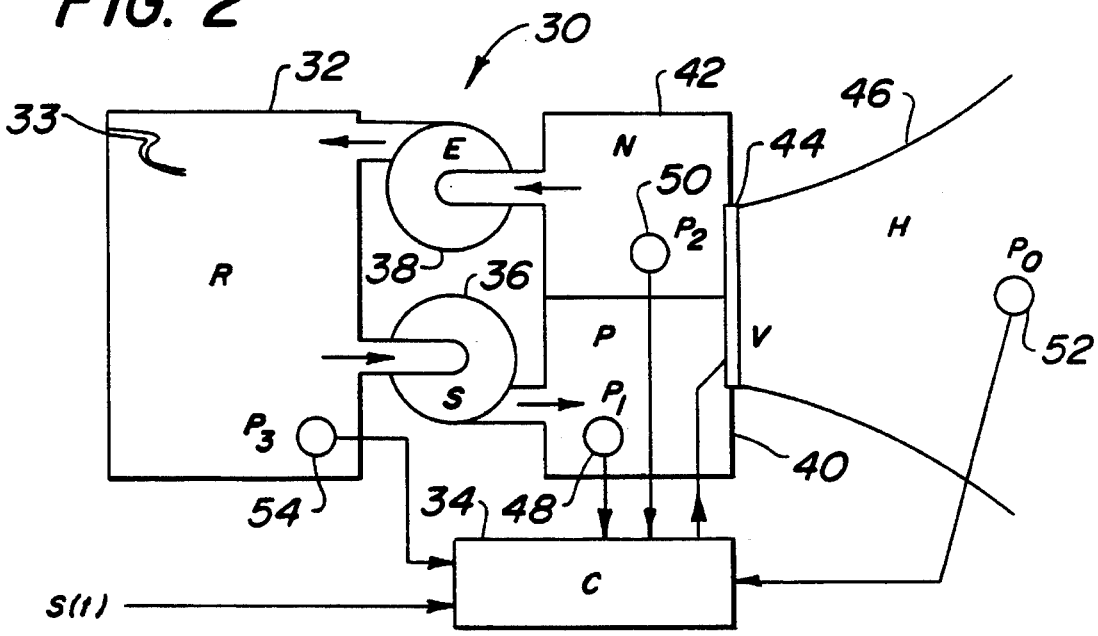
FIG. 2 schematically depicts a second embodiment of a high-volume acoustic source in accordance with the present invention.

FIG. 2 depicts a second and preferred embodiment of the present invention. In particular, FIG. 2 depicts a closed-circuit modulated-flow acoustic source 30. This embodiment reduces the non-linearity of the acoustic output while maintaining high acoustic power and efficiency. In this embodiment, separate valves are used to control both output to the horn and inflow from the same horn, which compensates for valve non-linearity.

In the prior art, small modulating valves are employed. Therefore, each valve's output must be coupled to a high acoustic impedance, that is, to a small area. When a large amount of acoustic power is propagated through a small area, the intensity (power per unit area) is high. If the intensity is high enough, the fluid becomes non-linear. For example, at a typical prior art intensity of $3\times10^6$ $W/m^2$ and a frequency of 100 Hz in air, a shock wave will be formed within a few feet of the source. In contrast, the inventive source 30 disclosed herein minimizes the acoustic non-linearity by using high-volume, low-pressure supply flows. In particular, the present invention employs either several large area-modulating valves or a multiplicity of smaller on/off valves, which impose low flow resistance when operated in combination. The driving pressure differentials drop with increasing flow as the valve openings are increased. To compensate for this pressure drop, the controller senses the instantaneous pressure levels and uses this information to determine what valve openings are needed to achieve the required flows at each increment of time.

Referring now to FIG. 2, one presently preferred embodiment of a closed-circuit acoustic source 30 in accordance with the present invention comprises a reservoir 32 with a pressure relief 33; a controller 34; a supply blower 36; an exhaust blower 38; a positive plenum 40; a negative plenum 42; an orifice plate with valving 44; a horn 46; and pressure transducers 48, 50, 52, 54, feeding detected pressure levels to the controller 34. The electrical command signal s(t) is also shown being input to the controller 34. The command signal s(t) is a voltage analogous to the acoustic pressure or volume velocity to be output by the source.

The supply blower 36 supplies fluid to the horn when a positive volume output is required. The exhaust blower 38 pulls fluid from the horn when a negative volume output is required. If a single blower supplying both plena is employed, as discussed below in connection with FIG. 6, this blower preferably will be a centrifugal-flow device such as a "squirrel cage" blower.

The orifice plate 44 is physically located between the plena 40, 42 and the horn 46. The orifice plate bears several modulating valves or a multiplicity of on/off valves, each with its own orifice and actuator. For clarity, the plena 40 and 42 are shown side by side. However, in an actual implementation of the invention, valves connected to the positive plena 40 and negative plena 42 will preferably be interleaved to satisfy the following conditions:

1) valves into each plena occupy equal areas of the orifice plate;
2) the distance between positive and negative valves is smaller than the wavelength of sound to be radiated; and
3) the flow resistance through the plena is less than that through the associated orifices when all valves are open.

Figure 3:
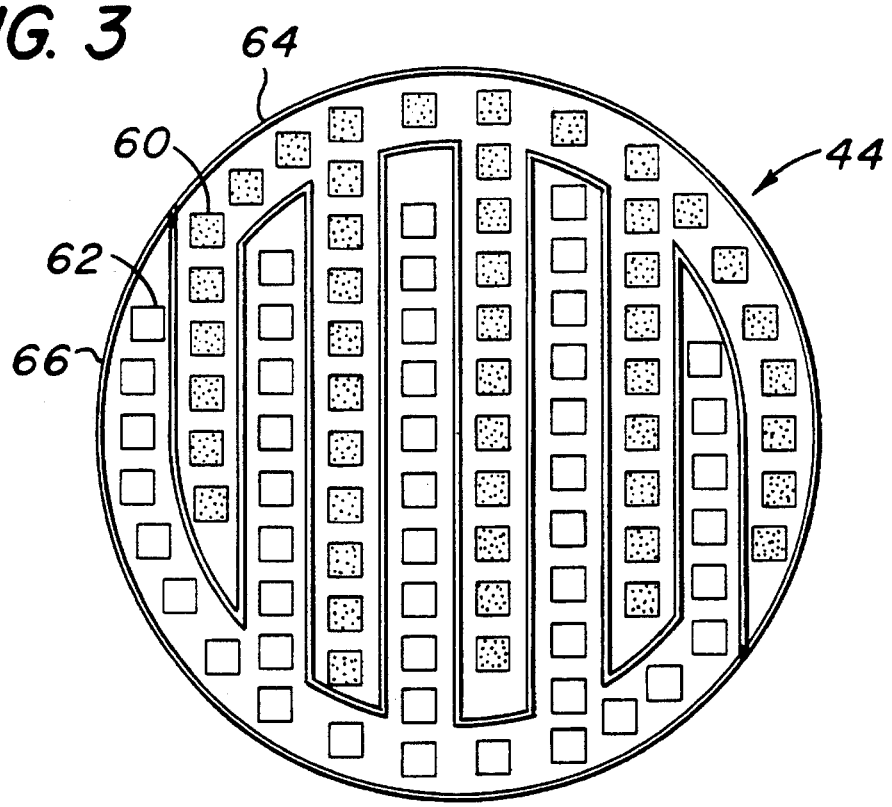
FIG. 3 schematically depicts a layout of an orifice plate comprising positive plenum valves and negative plenum valves on equal, complementarily shaped areas of a circular orifice plate.

FIG. 3 schematically depicts an orifice plate configuration for a large number of valves. In this exemplary embodiment, forty-eight on-off valves 60 are distributed over the circular orifice plate surface. The valves 60 are supported by the positive pressure plenum 64. A complementary area supports forty-eight valves 62 connected to the negative pressure plenum 66.

Figure 4:
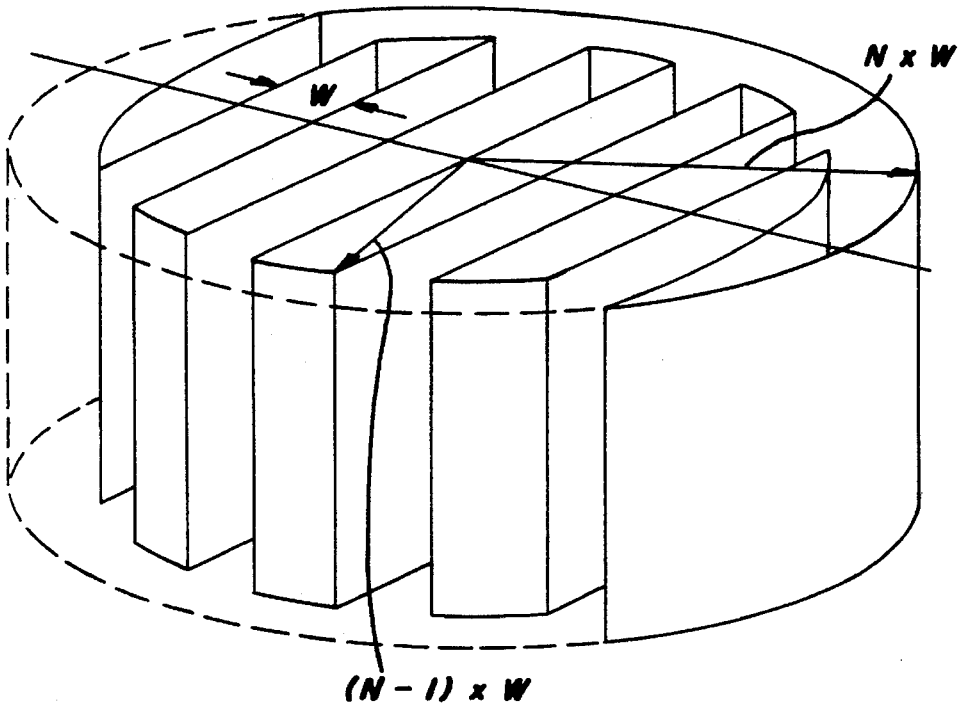
FIG. 4 depicts a phantom view of the plenum underlying the schematic valve layout, showing the channel width W, the outer radius (N×W) and the inner radius (N−1)×W, for N=5.

FIG. 4 is a phantom view of the corresponding plenum assembly. Its labyrinthine design provides N parallel channels for positive and negative pressure valves. If the channel width is W, the outside diameter is N×W and the inside diameter (at the arcs terminating the channels) is (N−1)×W, where N is a suitable integer. In FIG. 4, N=5. Alternative arrangements could include zoning as concentric circles or zoning as sectors of a circle. Accordingly, the present invention is by no means limited to the configuration depicted in FIGS. 3 and 4.

The controller 34 converts the electrical signal s(t) to a sequence of valve operations and compensates for changes in pressure of the plena 40, 42, as measured by pressure transducers 48, 50, and 54. Pressure transducer 52 provides an optional feedback signal for the controller to correct the source output.

When the signal amplitude is 0, a predetermined number of on-off valves are opened, or a modulating valve is partially opened. Under this condition, the supply blower 36 creates an excess pressure above gauge in the positive plenum 40 by moving fluid out of the reservoir 32. The exhaust blower 38 creates a negative pressure below gage in the negative plenum 42 by moving fluid out of the negative plenum and into the reservoir 32. The reservoir remains near atmospheric pressure. The small pressure relief port 33 has a high flow impedance, so that acoustic frequencies are unaffected but an under-pressure or over-pressure condition in the reservoir is gradually relieved.

If the electrical signal s(t) becomes positive, the controller 34 opens an increased number of on-off valves or further opens one or more modulating valves between the positive plenum 40 and the horn 46. The controller 34 determines which valves to open depending on the amplitude desired and on the plenum and reservoir pressures. The pressures inside the positive plenum will tend to decrease due to the flow out through the orifice plate 44, and will be restored by the supply blower 36 from the reservoir. Simultaneously, the controller reduces the valve opening between the negative plenum 42 and the horn 46.

If the electrical signal s(t) becomes negative, the controller increases the valve opening between the negative plenum 42 and the horn 46. Fluid will flow from the output into the negative plenum, tending to raise its pressure to ambient. The exhaust blower 38 will transport fluid from the negative plenum into the reservoir 32, acting to restore the negative static pressure in the negative plenum. Simultaneously, the controller 34 reduces the valve opening for the positive plenum 40.

An acoustic output is thus produced as an alternating net volume velocity injected into the horn 46. FIG. 5(*a*) depicts an exemplary assumed command signal s(t) representative of the desired volume velocity injected into the horn. FIG. 5(*b*) depicts waveforms representing volume velocities through individual valves or valve groups for an outflow-only device (left waveform) and a closed-circuit device (right waveform). For the closed-circuit device waveform in FIG. 5(*b*), the quiescent flow region, inflow region, and outflow region are identified. Time histories of the individual volume velocities are plotted in FIG. 5(*b*) corresponding to the command signal depicted in FIG. 5(*a*). Under conditions of zero command input, the valves would be open a small percentage of maximum. This is the "quiescent flow" depicted in FIG. 5(*b*). The advantage in terms of pneumatic efficiency over a simple outflow only device is the reduction in total absolute volume velocity seen in FIG. 5(*b*). The amount of quiescent flow reduced will be based largely on the requirements for avoidance of intermodulation distortion. FIG. 5(*c*) depicts waveforms representing the net volume velocity into the horn for the outflow-only device and the closed-circuit device, as in FIG. 5(*b*). FIG. 5(*d*) depicts waveforms representing the total absolute volume velocity (associated with power loss due to flow) for the outflow-only device and the closed circuit device, as in FIG. 5(*b*) and 5(*c*).

Small-Signal and Large-Signal Operation

When the electrical signal s(t) is small, the plena 40 and 42 will remain close to their static pressure values and reservoir 32 will remain near atmospheric pressure. When s(t) is large, the active plenum during each half cycle will move closer to atmospheric pressure. The reservoir and idle plenum will be charged with pressure opposite to that in the active plenum. The fluid transported through the negative plenum into the reservoir during a negative excursion is available to be moved out through the positive plenum during the following positive excursion. Similarly, the fluid moved out of the reservoir during a positive excursion makes room for the fluid which will be injected during the next negative excursion. The maximum output amplitude is determined by two values related to the blower and the flow resistance of the path: (1) the maximum flow which the blowers can drive through the orifice plate and (2) the pressure difference at which the blowers stall. These parameters determine the instantaneous peak volume velocity limit and the maximum volume per half cycle.

Acoustic Horn

The power of the acoustic output is the square of the volume velocity through the orifice plate 44 times the acoustic resistance at the throat of the horn 46. At low frequencies and in the absence of reflections, the resistance of a constant cross-section duct is approximately $Z_c/S_0$, where $Z_c$ is the characteristic impedance of the fluid and $S_0$ is the area of the duct. A low-frequency acoustic wave will propagate through the duct as a plane wave. If it is desired to radiate a low-frequency acoustic wave into free space, the use of an acoustic horn will greatly increase the output acoustic power by matching the radiation impedance to the source impedance. The disclosed acoustic source concept is compatible with conventional horn design methods.

Figure 6:
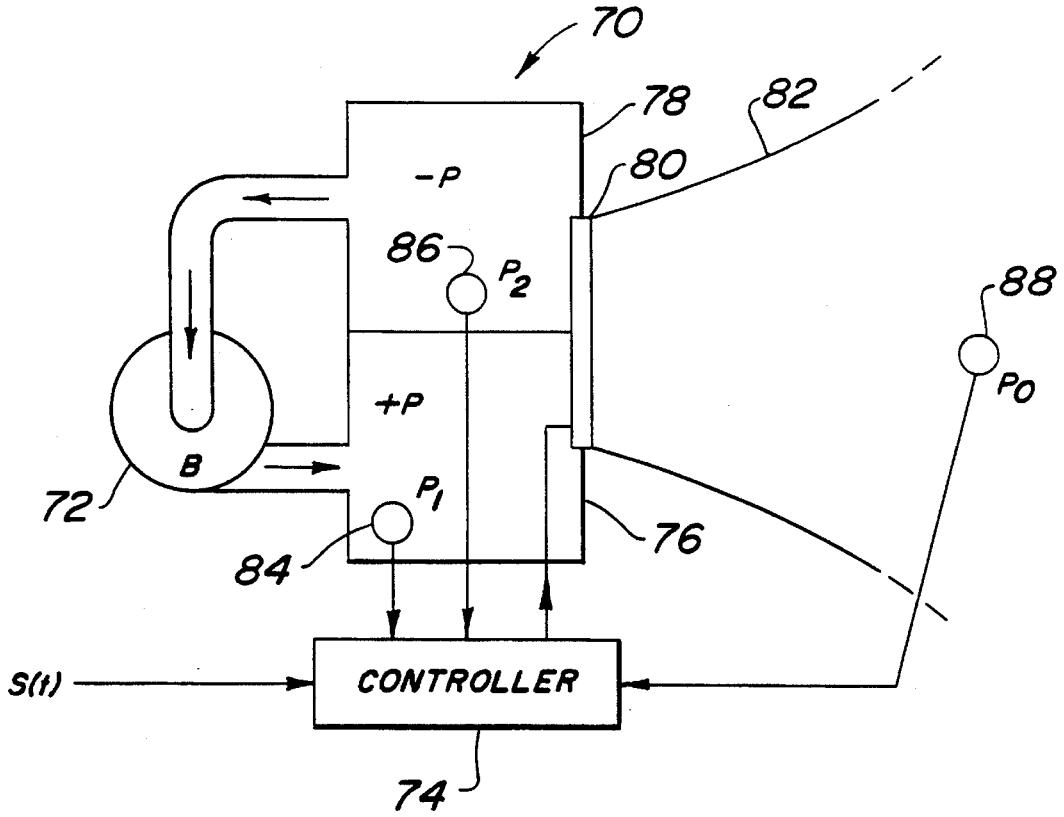
FIG. 6 schematically depicts a third embodiment of a high-volume acoustic source in accordance with the present invention. This embodiment differs from the embodiment of FIG. 2 in that this embodiment employs a single blower instead of the source blower and exhaust blower of the FIG. 2 embodiment.

An alternative single-blower acoustic source implementation is depicted in FIG. 6. In this embodiment, only one blower 72 is employed to transport fluid out of the negative pressure plenum 78 and into the positive pressure plenum 76. The volumes of the plena 76, 78 should be substantially greater than the maximum volume required per cycle, so that the pressures inside the plena will remain comparatively close to their static values. As shown in FIG. 6, the single-blower embodiment of the source 70 is similar to the embodiment of FIG. 2 in that it includes, in addition to the single blower 72, a controller 74; the positive pressure plenum 76 and negative pressure plenum 78; an orifice plate 80; a horn 82; and pressure transducers 84, 86, 88.

In principle, the positive and negative flows could be controlled either by one or more modulating valves or by a multiplicity of on-off valves per pressure plenum. The modulating valve alternative provides simplicity of design, since each plenum could have as few as one valve. In addition, the modulating valve alternative provides simple control, since the flow resistance is a well-established function of the open area. On the other hand, the on-off valve alternative may enable larger net volume velocities and higher acoustic power output levels to be attained, if the on-off valves are used in large numbers. The acoustic source concept disclosed herein is also compatible with the use of fluidic devices, either on-off or modulating, in lieu of mechanical valving to control the flow. The advantages of fluidic devices include the absence of moving parts and, if used in large numbers of small-sized elements, the potential for obtaining shorter response times than achievable with mechanical valving.

In most applications, the disclosed acoustic source would transmit acoustic power to free space via sound waves that propagate out of the mouth of the horn. However, some applications may require that the sound be injected into a closed duct. In the latter case, a constant-area duct that tees into the main duct could be substituted for the horn as the output-transmitting component. This substitution is likely to be made because the acoustic impedance inside the main duct will differ significantly from the free-space impedance on which the horn design is based.

In addition, the disclosed acoustic source can use any suitable gas, including the stack gas in a combustion exhaust system, as an alternative to ambient air.

The advantages provided by the closed-circuit embodiment of the present invention include the following:

1) Input/Output Linearization: the disclosed concept represents a great improvement in linearity over the existing art in controllable modulated-flow acoustic sources. The non-linearities associated with high-amplitude pressure oscillations are minimized by using acoustic horns of modest mouth-to-throat area ratios as output devices. The non-linearities associated with valving are minimized by (a) simultaneously valving the outflow and the inflow of the working fluid, and by (b) employing an electronic controller that compensates for the inherent non-linearities in flow/pressure differential characteristics of the valving and continuously makes corrections for changes in the plenum pressure levels.

2) Prevention of Extraneous Sound Radiation: If an outflow-only acoustic source were to be used in conjunction with a squirrel-cage or other low-pressure air supply blower, sound propagation from the valving backward through the blower and the air supply system ducts could cause a problem by contaminating the main acoustic output. The disclosed concept minimizes this risk by totally enclosing the sound paths that are acoustically upstream of the horn.

3) Improved Acoustic-Efficiency: Due to the low quiescent flows of the working fluid and the use of low supply pressures, the consumption of pneumatic power by the disclosed acoustic source is likely to be much smaller for a given level of acoustic output power than in the prior art.

We claim:

1. A high-volume acoustic transducer, comprising:

(a) a positive plenum characterized by a positive pressure;

(b) a negative plenum characterized by a negative pressure less than said positive pressure;

(c) blower means coupled to said positive and negative plena for supplying a fluid to said positive plenum and withdrawing said fluid from said negative plenum, wherein said fluid comprises a member of a group consisting of: a gas, a mixture of gases, a mixture of combustion exhaust products, and air;

(d) an orifice plate containing a plurality of valves for controllably releasing said fluid from said positive plenum and accepting said fluid into said negative plenum, said valves comprise a member of a group consisting of large area-modulatinq valves and on/off valves; and (e) a controller for controlling the operations of said valves in accordance with an electrical signal, wherein an acoustic signal generated by the high-volume transducer is analogous to said electrical signal, and wherein a fluid-to-fluid energy transfer takes place between said transducer and a surrounding environment.

2. A high-volume acoustic transducer as recited in claim 1, further comprising a reservoir containing said fluid, said reservoir coupled to said blower means.

3. A high-volume acoustic transducer as recited in claim 1, further comprising a horn coupled to said orifice plate for matching the acoustic impedance of the transducer to a free space.

4. A high-volume acoustic transducer as recited in claim 1, further comprising first and second pressure transducers in said plena, said pressure transducers feeding pressure levels detected in said plena to said controller, whereby said controller is enabled to compensate for changes in pressure of the plena in converting the electrical signal to a sequence of valve operations.

5. A high-volume acoustic transducer as recited in claim 2, further comprising a pressure transducer in said reservoir, said pressure transducer feeding pressure levels detected in said reservoir to said controller, whereby said controller is enabled to compensate for changes in pressure of the reservoir in converting the electrical signal to a sequence of valve operations.

6. A high-volume acoustic transducer as recited in claim 1, further comprising a feedback pressure transducer outside said plena adjacent to said orifice plate, said feedback pressure transducer feeding pressure levels indicative of said acoustic signal generated by the high-volume transducer to said controller.

7. A high-volume acoustic transducer as recited in claim 2, wherein said reservoir comprises a pressure relief port having a high flow impedance for relieving an under-pressure or over-pressure condition in the reservoir.

8. A high-volume acoustic transducer as recited in claim 2, wherein said blower means comprises a supply blower coupled between said reservoir and said positive plenum, and an exhaust blower coupled between said reservoir and said negative plenum.

9. A high-volume acoustic transducer as recited in claim 1, wherein said blower means comprises a single blower coupled between said positive plenum and said negative plenum.

10. A high-volume acoustic transducer as recited in claim 2, further comprising:

a horn coupled to said orifice plate for matching the acoustic impedance of the transducer to a free space;

first and second pressure transducers in said plena, said first and second pressure transducers feeding pressure levels detected in said plena to said controller, whereby said controller is enabled to compensate for changes in pressure of the plena in converting the electrical signal to a sequence of valve operations;

a third pressure transducer in said reservoir, said third pressure transducer feeding pressure levels detected in said reservoir to said controller, whereby said controller is enabled to compensate for changes in pressure of the reservoir in converting the electrical signal to a sequence of valve operations;

a feedback pressure transducer outside said plena adjacent to said orifice plate, said feedback pressure transducer feeding pressure levels indicative of said acoustic signal generated by the high-volume transducer to said controller; and pressure relief means for relieving an under-pressure or over-pressure condition in the reservoir.

11. A high-volume acoustic transducer as recited in claim 10, wherein said blower means comprises a supply blower coupled between said reservoir and said positive plenum, and an exhaust blower coupled between said reservoir and said negative plenum.

12. A high-volume acoustic transducer as recited in claim 10, wherein said blower means comprises a single blower coupled to said positive plenum and said negative plenum.

13. A method for generating a high-volume acoustic signal which is analogous to an electrical signal, comprising the steps of:

(a) maintaining the pressures ($P_1$, $P_2$) in first and second plena at prescribed levels, wherein said plena contain a working fluid, $P_1$ is positive relative to a surrounding atmospheric pressure, and $P_2$ is negative relative to the surrounding atmospheric pressure; and (b) generating a high-volume acoustic signal by controllably releasing said fluid from said positive plenum through a first set of valves and accepting said fluid into said negative plenum through a second set of valves;

wherein said fluid comprises a member of a group consisting of: a gas, a mixture of gases, a mixture of combustion exhaust products, and air; said valves comprise a member of a group consisting of large area-modulating valves and on/off valves, and wherein a fluid-to-fluid energy transfer takes place between said transducer and a surrounding environment.

14. A method as recited in claim 13, further comprising pulling said fluid from said second plenum and supplying said fluid to said first plenum in a closed-circuit fashion.

15. A method as recited in claim 13, further comprising pulling said fluid from said second plenum into a reservoir and supplying said fluid from said reservoir to said first plenum in a closed-circuit fashion.

16. A method as recited in claim 13, further comprising detecting the pressure levels in said plena and employing the detected pressure levels to compensate for changes in pressure of the plena in converting the electrical signal to a sequence of valve operations.

17. A method as recited in claim 15, further comprising detecting the pressure level in said reservoir and employing the detected pressure level to compensate for changes in pressure of the reservoir in converting the electrical signal to a sequence of valve operations.

18. A method as recited in claim 13, further comprising detecting the pressure level outside said plena adjacent to said valves and employing the detected pressure level as a feedback signal to improve the accuracy of the source output.

19. A system for generating a high-volume acoustic signal which is analogous to an electrical signal, comprising:

(a) means for maintaining the pressures ($P_1$, $P_2$) in first and second plena at prescribed levels, wherein said plena contain a working fluid, $P_1$ is positive relative to a surrounding atmospheric pressure, and $P_2$ is negative relative to the surrounding atmospheric pressure; and (b) means for generating a high-volume acoustic signal by controllably releasing said fluid from said positive plenum through a first set of valves and accepting said fluid into said negative plenum through a second set of valves;

wherein said fluid comprises a member of a group consisting of: a gas, a mixture of gases, a mixture of combustion exhaust products, and air; said valves comprise a member of a group consisting of large area-modulating valves and on/off valves, and wherein a fluid-to-fluid energy transfer takes place between said transducer and a surrounding environment.

20. A system as recited in claim 19, further comprising means for pulling said fluid from said second plenum and supplying said fluid to said first plenum in a closed-circuit fashion.

21. A system as recited in claim 19, further comprising a reservoir, and means for pulling said fluid from said second plenum into said reservoir and supplying said fluid from said reservoir to said first plenum in a closed-circuit fashion.

22. A system as recited in claim 19, further comprising means for detecting the pressure levels in said plena and employing the detected pressure levels to compensate for changes in pressure of the plena in converting the electrical signal to a sequence of valve operations.

23. A system as recited in claim 21, further comprising means for detecting the pressure level in said reservoir and employing the detected pressure level to compensate for changes in pressure of the reservoir in converting the electrical signal to a sequence of valve operations.

24. A system as recited in claim 19, further comprising means for detecting the pressure level outside said plena adjacent to said valves and employing the detected pressure level as a feedback signal to improve the accuracy of the source output.

25. A high-volume acoustic transducer, comprising:

(a) a positive pressure plenum characterized by positive pressure;

(b) blower means coupled to said plenum for supplying fluid to said plenum, wherein said fluid comprises a member of a group consisting of: a gas, a mixture of gases, a mixture of combustion exhaust products, and air;

(c) an orifice plate containing a plurality of on-off valves for controllably releasing said fluid from said plenum; and (d) a controller for controlling the operation of said valves in accordance with an electrical signal, wherein an acoustic signal generated by the high-volume transducer is analogous to said electrical signal, wherein a fluid-to-fluid energy transfer takes place between said transducer and a surrounding environment.

26. A high-volume acoustic transducer as recited in claim 25, further comprising a horn coupled to said orifice plate for matching the acoustic impedance of the transducer to a free space.

27. A high-volume acoustic transducer as recited in claim 25, further comprising a pressure transducer in said plenum, said transducer's output being input to said controller whereby said controller is enabled to compensate for changes in the pressure of said planum while converting the electrical signal to a sequence of valve operations.

28. A high-volume acoustic transducer as recited in claim 1, wherein said valves are fluidic valves each of which passes a predetermined volume flow.

29. A method as recited in claim 13, wherein said valves are fluidic valves each of which passes a predetermined volume flow.

30. A system as recited in claim 19, wherein said valves are fluidic valves each of which passes a predetermined volume flow.

31. A high-volume acoustic transducer as recited in claim 25, wherein said valves are fluidic valves each of which passes a predetermined volume flow.

* * * * *